United States Patent [19]

Viker et al.

[11] 3,964,415

[45] June 22, 1976

[54] CAN CLOSURE

[75] Inventors: Harris W. Viker, Roseville; William E. Kropp, North St. Paul, both of Minn.

[73] Assignee: Minnesota Mining and Manufacturing Company, St. Paul, Minn.

[22] Filed: Jan. 14, 1975

[21] Appl. No.: 540,980

Related U.S. Application Data

[62] Division of Ser. No. 393,001, Aug. 30, 1973, Pat. No. 3,889,844.

[52] U.S. Cl. ..... 113/121 C

[51] Int. Cl.[2] ..... B21D 51/44

[58] Field of Search.. 113/116 QA, 120 Q, 120 XY, 113/, 121 R, 121 A, 121 C; 220/359, 361, 363, 350

[56] References Cited

UNITED STATES PATENTS

| | | | |
|---|---|---|---|
| 564,492 | 7/1896 | Westerbeck | 220/359 |
| 3,251,515 | 5/1966 | Henchert et al. | 220/359 |
| 3,281,024 | 10/1966 | Henchert et al. | 220/359 |
| 3,292,828 | 12/1966 | Stuart | 220/359 |
| 3,331,422 | 7/1967 | Hafner et al. | 220/359 |
| 3,397,811 | 8/1968 | Lipske | 113/121 C |
| 3,547,305 | 12/1970 | Khoury | 220/359 |

*Primary Examiner*—Milton S. Mehr

*Attorney, Agent, or Firm*—Alexander, Sell, Steldt & DeLaHunt

[57] ABSTRACT

Cans sealed with removable pressure-sensitive adhesive tape tabs over a pour hole successfully contain carbonated beverages or other pressure-generating liquids if the area around the pour hole and under the tape is slightly elevated, thereby putting the tape in shear rather in peel. Circular can ends may be provided with a circular pour hole, taped and then shaped to impart a frusto-conical area around the pour hole before being crimped over the tubular can body.

3 Claims, 3 Drawing Figures

CAN CLOSURE

CROSS REFERENCE TO RELATED APPLICATION

This application is a division of copending U.S. Pat. application Ser. No. 393,001, filed Aug. 30, 1973, now U.S. Pat. No. 3,889,844.

BACKGROUND OF THE INVENTION

This invention relates to liquid-containing cans of the type in which a pour hole is covered by a removable pressure-sensitive adhesive tape tab. The invention also relates to end walls useful for the manufacture of such cans and to methods of preparing such end walls.

Over the past several years there has been an increasing use of metal containers for carbonated soft drinks and beer. These containers are opened by lifting and grasping a ring attached to the end wall and removing a portion of the wall along weakened tear lines. Because aluminum is the only commercially available metal which can be formed into a readily openable end wall in this manner, the original "tear-top" cans were made entirely out of aluminum. To make such cans more economical, carbonated beverage manufacturers later resorted to fabricating the tubular side wall and one end wall from steel, using openable aluminum for only the other end wall. In some cases an aluminum insert, including a tear strip was incorporated into a steel can end. Although such dual metal cans are satisfactory for the intended use, it is ecologically desirable today for empty cans to be capable of simple recycling; the separation of the aluminum from steel is both inconvenient and expensive. Additionally, several states and cities have banned the use of ring pull cans because the removed tabs are so commonly dropped on the ground or thrown into a body of water, where they decompose only very slowly.

It is known that unpressurized cans containing tomato juice and similar liquids can be provided with a convenient means for opening by pre-punching a hole in one end wall and applying a pressure-sensitive adhesive tape, tab over the hole. When the user desires to open such a container, he grasps the free end of the tape tab and pulls the closure off, exposing the hole in the end wall to permit pouring out the contents of the can. Easy-open containers of this type are shown in U.S. Pat. No. 3,389,827, the disclosure of which is incorporated herein by reference.

Various attempts have been made to adapt the sealing technology of the aforementioned patent to the packaging of gas-containing liquids such as carbonated soft drinks and beer, but these attempts have not proved commercially satisfactory. Typical pressures for various beverages at 38°C. are as follows: orange pop, 1.7 kg/cm$^2$; strong beer, 3.3 kg/cm$^2$; root beer, ginger ale, cola and lemon, 4.5 kg/cm$^2$; club soda, 5.8 kg/cm$^2$. At room temperature (21°C.), pressures are about 70% and even under normal refrigeration (e.g., 4–5°C.), they are about 40%, of the values just cited. Such pressures bulge prior art tape closures upward and gradually peel them from the area immediately circumjacent ot the pour hole, and, in a relatively short time, break the seals. Prior to the present time, then, it has been felt that tape closures could not be employed in the sealing of highly pressurized containers.

SUMMARY

The present invention provides a closed liquid-filled hollow container which is economical to manufacture, utilizes the simple and easily operated pressure-sensitive adhesive tab of the type shown in U.S. Pat. No. 3,389,827, can be fabricated entirely from steel, and resists high internal pressures for an extended period of time.

In accordance with the invention, the area of the can wall immediately circumjacent to the pour hole is so contoured that it tapers outward, and the hole is thus located in a plane displaced outward with respect to the rest of the end wall. When the can is filled with a pressure-generating liquid, the portion of the tape covering the hole bulges outward, as in previous construction. Because of the contour of the can wall circumjacent to the hole, however, the forces acting on the tape tend to place the adhesive in shear (i.e., the forces are exerted parallel to the tape backing) instead of in peel (i.e., where the forces are exerted at right angles to the tape backing). Since the shear force required to loosen the tape greatly exceeds the peel force required to loosen it, the container can be subjected to substantially higher internal pressure without seal failure than is possible when the hole is located in the same plane as the remainder of the wall.

In fabricating containers of the invention, it has been found convenient to employ a subassembly comprising a preformed circular end piece which is a modification of the conventional tube, having a depressed center end wall with a died-out pour hole and a circumferential lip for clamping over and sealing to one end of tubular metal can body. The modification is conveniently made by applying to the depressed center portion of the end piece a strip of normally tacky and pressure-sensitive adhesive tape so that it overlies the pour hole and is sealed to the circumjacent surface, supporting the taped side of the end piece in an area adjacent to but spaced slightly outward from the pour hole, and firmly gripping the end piece in this area. The area of the end wall immediately circumjacent to the pour hole is then tapered outward by forcing a blunt punch into the pour hole from the side of the end piece which has not been taped. Where the pour hole is circular, the punch normally will have a head with a circular cross section in a plane taken at right angles to the axis of the punch. The distal end of the head than has a diameter smaller than that of the pour hole and the remainder of the head has a diameter larger than that of the pour hole; the head may be beveled, tapered, chamfered, or curved in order to achieve this shape. As the head is forced into the pour hole, it imparts an open-topped outwardly tapered configuration to the taped side of the end piece, simultaneously stretching the tape and leaving it firmly adhered.

BRIEF DESCRIPTION OF THE DRAWING

Understanding of the invention will be further facilitated by reference to the accompanying drawing, in which like numbers refers to like parts in the several views and in which.

DESCRIPTION OF PRESENTLY PREFERRED EMBODIMENTS

Figure 1:
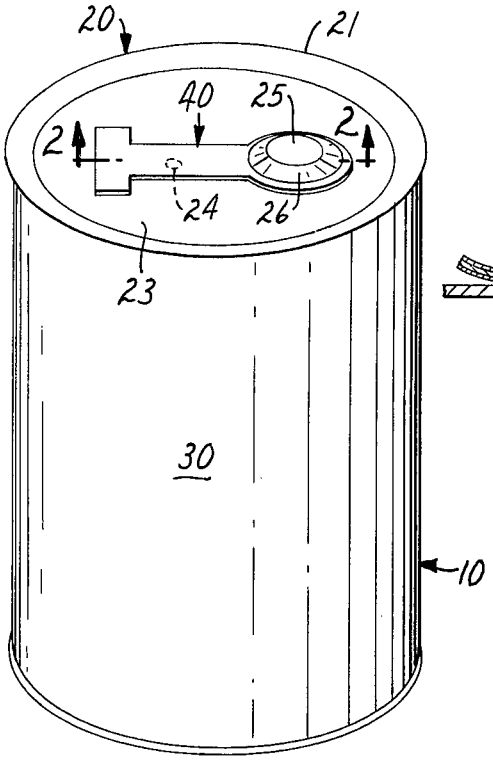
FIG. 1 is a perspective view of a can made in accordance with the present invention.

In evaluating the effectiveness of can end walls made in accordance with the invention to resist pressure, it has been found convenient to employ a water-tight chamber equipped with an electric heating element and having temperature controls in the base. The chamber is provided with a top having several 68.3-mm holes designed to accommodate can lids for pressure testing. A lid hinged to the chamber contains several 68.3-mm holes corresponding to those in the top of the chamber. Can end walls to be tested are mounted over the holes in the top, after which the cover is bolted to the chamber. To perform a test, the water is heated to the desired test temperature, the desired air pressure supplied to the base of the chamber, and an electric timer mounted above each test lid started; the timer is connected to a pressure-activated switch, which in turn is connected to the lid. The switch is closed, and the timer thereby stopped, when the tape closure is sufficiently loosened to permit escape of the pressure in the chamber, thus marking the end of the test.

In the drawings, can 10 comprises generally circular upper end 20 and a tubular body 30. (Can 10, of course, has a generally circular lower end which is not visible). End 20 comprises a circumferential lip 21, having a resin coating 22 at its inner aspect; lip 21 fits down over the upper end of can body 30 and is crimped in position, resin 22 sealing the joint against leakage. The central portion of end wall 23 is depressed slightly with respect to lip 21, a common arrangement in can manufacture. Located in end wall 23 adjacent lip 21 is pour hole 25, which, if circular, typically has a diameter of 10–15 mm; slightly radially inward therefrom is located vent hole 24, which typically has a diameter of 11½ – 3 mm. In the area 26 circumjacent to pour hole 25, end wall 23 is so contoured that it tapers upward, leaving pour hole 25 situated in a plane spaced slightly (e.g., 2–4 mm) above the remainder of end wall 23. To minimize damage, especially in stacking or handling, pour hole 25 is preferably located in a plane which is slightly lower than the upper portion of lip 21. The difference in elevation between the pour hole 25 and can end wall 23 in the formed end 20 should usually be, for a 12.7-mm pour hole, on the order of 2½ – 3mm, and the angle of the sides to the base should generally exceed 20° to insure placing the tape closure in a shear mode adequate to resist failure under anticipated conditions of use.

Figure 2:
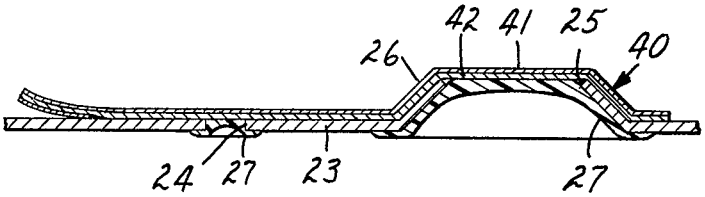
FIG. 2 is a cross section of the end wall of the can shown in FIG. 1, taken along section line 2—2 and looking in the direction of the arrows.

Overlying pour hole 25 and vent hole 24 is sealing tab 40, the construction of which is shown best in the cross-sectional view of FIG. 2. Tab 40 comprises stretchable backing 41, advantageously formed of a strong oriented synthetic polymeric film which is 25–250 microns thick, although metal foil or reinforced fibrous sheet material can probably be employed in some circumstances. It is important, however, that the backing of the sealing tab be relatively impermeable to water vapor, carbon dioxide and oxygen. Water vapor transmission, for example, should not exceed 1.7–1.8 gms/100 in²/24 hr/mil at 23°C. when measured in accordance with ASTM Test E96. Carbon dioxide should have a permeability rate which does not exceed 15–25cc/100 in²/24 hr/atmosphere at 25°C., and oxygen permeability should not exceed about 30–40 percent of this figure; see ASTM Test D 1434. It is also important for the film to be capable of elongating 10–200% at break so that the tab can be stretched to conform to the convex area around the pour hole. To insure continued smooth conformance, the stretched backing should not, after withdrawing the stretching force, retract more than 30 percent of the incremental amount stretched; in fact, a backing which possesses "dead stretch" (i.e., no retraction) is preferred.

In order to minimize any difference in appearance between tab 40 and the end wall 23, it is often desirable to impart a metallic appearance to sealing tab 40; this can be accomplished by laminating a metal foil or a thin transparent polymeric film, aluminum vapor coated on its lower surface, over the top of backing 41. If desired, backing 41 may be provided with a thin coating of vapor-deposited aluminum on its exposed surface. Coated over the lower surface of backing 41 is a layer of firmly adherently bonded normally tacky and pressure-sensitive adhesive 42. The distal end of the tab 40 is made easier to grasp initially by covering a portion of the adhesive with a small piece of film or paper. The nature of the adhesive layer should be such that the force required to peel it from steel (U.S. Federal Standard No. 147) should be in the range of 0.9–2,8 kg/cm width to insure adequate adhesion and yet permit removal of the tab with a reasonable amount of effort. The backing must, of course, be strong enough not to tear during removal.

In order to minimize corrosion of the raw edge of end wall 23 which immediately surrounds vent hole 24 and pour hole 25, it is generally preferred to apply a light coating of a protective polymeric material 27 after sealing tab 40 has been adhered in place; this protective coating also covers the exposed surface of pressure-sensitive adhesive 42, obviating any possibility that the can contents may be contaminated with undesirable flavors leached from the adhesive. In carrying out the pressure test described above, it has been found that more consistent results are obtained if coating 27 is eliminated; in the actual packaging of carbonated liquids, however, coating 27 is normally included.

Figure 3:
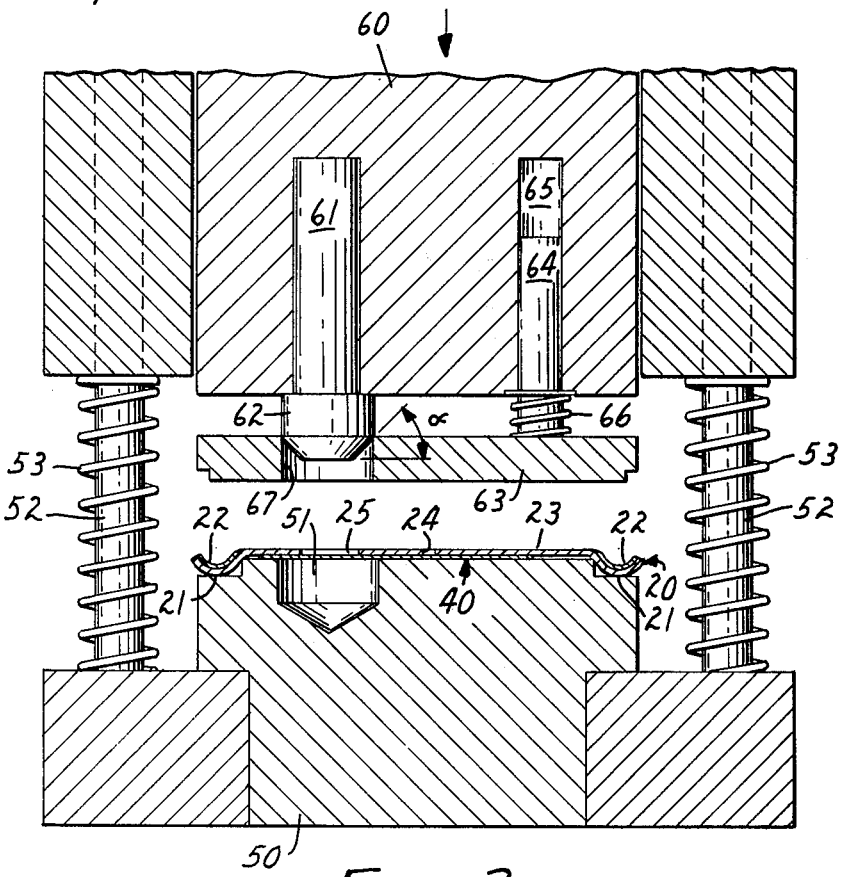
FIG. 3 is a cross sectional view of a forming press suitable for imparting a frusto-conical configuration to the end wall of a can in the area immediately circumjacent to the pour hole.

Turning now to FIG. 3, the method of forming can end 20 in accordance with the invention will be discussed. Vent hole 24 and pour hole 25 are die-cut from the end wall 23 of an end 20, sealing tab 40 applied thereover, and a protective coating 27 of lacquer or the like applied to protect the raw edges. End 20 is then inverted and placed atop a circular support table 50, the diameter of which is the same as the diameter of end wall 23. In the upper surface of table 50 is a generally cylindrical cavity 51, the diameter of which is somewhat greater than the diameter of pour hole 25. Can end 20 is so positioned that pour hole 25 is centered over cavity 51.

Connected to table 50 by means of supporting member 52 is press head 60, coil springs 53 surrounding member 52 to maintain the press in normally open position. Punch 61, at the lower end of which is chamfered head 62 is seated in press head 60. The location of head 62 may be controlled by the insertion shims (not shown) between tne lower surface of press head 60 and the upper surface of head 62. Suspended somewhat below the lower surface of press head 60 is forming ring 63, supported by three guide pins 64, only one of which is shown in the drawing. Guide pin 64 slides in channel 65, spring 66 surrounding the exposed portion of guide pin 64 and holding forming ring 63 a fixed distance beneath the lower surface of press body 60. Positioned in axially aligned relationship with respect to punch 61 is hole 67, the diameter of which is slightly greater than the greatest diameter of head 62.

After can end 20 is positioned on the upper surface of table 50, press head 60 is lowered, bringing draw ring 63 into snug contact with end wall 23 everywhere except in the portion of end wall 23 immediately circumjacent to pour hole 25. As head 60 is further lowered, punch head 62 contacts the portion of end wall 23 which defines pour hole 25 and gradually forces it into a frusto-conical shape, the configuation of which is dictated by the angle, $\alpha$, of the chamfered portion of head 62.

In many situations it may be preferable to employ a pour hole which is other than circular, e.g., an elliptical hole which takes the place of both pour hole 25 and vent hole 24. The same principles of tapering the area circumjacent such a hole apply, but the resultant shape is not a frustum in the strict geometric sense. As used herein, however, the terms "frustum," "frusto-conical," etc., are intended to be liberally construed so as to embrace such shapes. Similarly, where the term "diameter" is employed, it is not intended that a circular cross-section is necessarily connoted thereby.

For some purposes, pour hole 25 need not be a single large hole but may be a plurality of closely spaced smaller holes. In this event, all the holes should be located in the plane which is spaced farthest from the upper surface of end wall 23. Likewise, although holes which have the shape of a circle or regular polygon are simple and economical, teardrop, oval, or other shapes may be employed. Where the hole is non-circular, however, it is desirable to use tape which has dead stretch, or at least very little elastic memory.

Understanding of the invention will be further facilitated by reference to the following illustrative but non-limiting examples, in which all parts are by weight unless otherwise noted.

EXAMPLE 1

Biaxially oriented polyethylene terephthalate film approximately 90 microns thick was provided on one face with a thin vapor coating of aluminum to impart a metallic appearance. The opposite face was then coated with a thin primer layer of a styrene-butadiene-styrene block copolymer in which each of the two polystyrene blocks had a molecular weight of about 15,000 and the polybutadiene block had a molecular weight of about 70,000. (A suitable copolymer of this type is available from Shell Chemical Company under the registered trademark "Kraton" 1101.) The coating was then exposed to a corona discharge to bond it firmly to the film backing. Over the primed face was applied a 30 percent toluene solution containing 100 parts of the same block copolymer and 95 parts of a polyterpene resin containing alpha-pinene and having a ring-and-ball softening point (ASTM Test E28–58T) of 135°C. (A suitable polyterpene resin is available from Pennsylvania Industrial Chemical Corporation under the registered trademark designation "Piccolyte" $\alpha$ 135.) The coated solution was then oven dried to leave a pressure-sensitive adhesive coating weighing approximately 6 mgm/cm$^2$. The sheet material was then wound into roll form, a silicone-coated paper release liner being interposed between adjacent convolutions in the roll.

From the linered pressure-sensitive sheet material described in the preceding paragraph a tab similar in shape to tab 40 in FIG. 1 was died. The overall length of the tab was just over 50 mm, the distal gripping portion being 25 mm wide and 10 mm deep, the central portion 12½ mm wide × 18 mm long, and the circular end 22 mm in diameter. A strip of paper was then applied to the pressure-sensitive adhesive coating of the gripping portion.

A conventional 68.3-mm diameter depressed-center beverage can end was punched as shown in FIG. 1 so that it had a pour hole approximately 9.5 mm in diameter and a vent hole approximately 1.6 mm in diameter. Over the outer surface of the can end was then applied the tab described in the preceding paragraph, the resulting laminate being subjected to a pressure of approximately 40 kg/cm$^2$ at 50°C. (Adhesion may be further increased by utilizing higher temperatures, higher pressures, or both. For many end uses, however, application may be made at room temperature and pressures as low as 6 kg/cm$^2$.) Over the lower surface of the can lid, in the areas immediately adjacent to the edges of the pour hole and the vent hole, was applied a 25 percent toluene solution of a protective rubber-resin coating. The solid material consisted of 100 parts of the block copolymer used in the primer coating (described earlier in this example) and 180 parts of a non-oxidizing white hydrocarbon copolymer of 65 percent m- and p-vinyl toluene and 35 percent alpha-methyl styrene. (A suitable hydrocarbon copolymer of this type, having an ASTM E28–58T ball-and-ring softening point of 92°C., is available from Pennsylvania Industrial Chemical Corporation under the registered trademark "Piccotex" LC.) The solvent was evaporated and the taped, edge-sealed can end placed in a 65°C. oven for 4 hours to enhance adhesion of the tab; longer times, higher temperatures, or both, improve adhesion still more.

The taped lid, prepared as just described, was shaped on an apparatus similar to that shown in FIG. 3, as described earlier, so as to impart a frustum-like configuration to the pour hole and the immediately surrounding area. The pour hole opening was enlarged to a diameter of about 11 mm, and the height of the frustum was about 2.2 mm above the remaining area of the can end. The sides of the frustum lay at an angle of about 30° to the remainder of the can lid, the base blending into the can end in a smooth curve.

When the sealed lid was mounted on the end of a can containing pressurized liquid, it functioned extremely effectively but could be removed easily.

Tabulated below are examples showing the effect of several variables on the performance of products made in accordance with the invention. None of these examples included a protective edge sealing coat; otherwise, all are made in substantially the same way as Example 1. Each example is preceded by a control, which is identical to the example except that the can lid is tested in its original flat condition.

For convenience, the following abbreviations are employed in the table:

| | |
|---|---|
| PET | Biaxially oriented polyethylene terephthalate film |
| IPP | Biaxially oriented isotactic polypropylene film |
| ASA | Elastomeric film of 23:48:28 acrylonitrile:styrene: butyl acrylate polymer, having a density of 1.07 and a melt index at 200°C./21.6 kgf of 8–12 g/mm, per ASTM Test No. 1238. Resin of this type is available from BASF under the trade designation "Luran", and film is sold by Richman Chemical Company as "Richform" ASA. |

-continued

| | |
|---|---|
| SBS | Adhesive blend of 100 parts of the block copolymer of Example 1 and 90 parts of α-pinene resin having a ball-and-ring softening point of 135°C., coated from 40% solution in toluene |
| Crude | Adhesive blend of 100 parts crude rubber smoked sheets, 19 parts phenol-formaldehyde resin, 19 parts wood rosin and 65 parts poly-β-terpene. |
| VOAC: 2EHA: VA:EA | Adhesive based on vinyl acetate:2-ethylhexyl acrylate:vinyl alcohol:acrylic acid polymer (e.g., available from Monsanto under the registered trademark "Gelva" MP5-276), crosslinked with polycarbodiimide |
| VA: EA: 2EHA: AA | Adhesive based on 27:19:51:3 vinyl acetate: ethyl acrylate:2-ethylhexyl acrylate:acrylic acid polymer (e.g., available from Ashland Chemical Company under the registered trademark " Aeroset" 1044), crosslinked with p-toluene sulfonic acid-catalyzed melamine resin |
| IOA: EA: AA | 50:40:10 iso-octyl acrylate:ethyl acrylate:acrylic acid terpolymer |
| Poly-amide | Polyamide resin having a ball-and-ring softening point of 140°C., a tensile strength of 50 kg/cm² at 24°C. and 350 kg/cm² at −29°C., and a Shore "A" hardness (ASTM Test D 1707-61) of 85, available from General Mills under the registered trademark designation "Versalon" 1140 |
| PEPU | Highly crystalline thermoplastic polyester-polyurethane resin which, in non-crystalline state, has a tack retention of 2 hours; stress-strain values are 64 kg/cm² at 40% elongation and 350 kg/cm² at 700% to break. (Suitable resins, disclosed in U.S. Patent No. 2,871,218, are available from B. F. Goodrich under the registered trademark, "Estane" 5712) |
| SPE | Soluble polyester formed by co-reacting isophthalic acid, terephthalic acid and ethylene glycol |

Examples 2–10

| Example | Film Backing Composition | Film Backing Thickness, microns | Primer | Adhesive | Test Temp.°C. | Effectiveness Pressure kg/cm² | Effectiveness Time to fail, min.* |
|---|---|---|---|---|---|---|---|
| Control | PET | 90 | SPE | SBS | 38 | 3.5 | 4,332 |
| 2 | PET | 90 | SPE | SBS | 38 | 3.5 | 10,000 |
| Control | PET | 90 | SPE | SBS | 38 | 5.25 | 25–30 |
| 3 | PET | 90 | SPE | SBS | 38 | 5.25 | 1,400 |
| Control | PET | 90 | SPE | SBS | 60 | 6.3 | 9–12 |
| 4 | PET | 90 | SPE | SBS | 60 | 6.3 | 112 |
| Control | PET, aluminum vapor-coated | 50 | SPE | IOA:EA:AA, peroxide-crosslinked | 38 | 3.5 | 80 |
| 5 | " | 50 | SPE | " | 38 | 3.5 | 181 |
| Control | IPP | 50 | Atactic polypropylene | Crude | 38 | 3.5 | 2–3 |
| 6 | IPP | 50 | " | Crude | 38 | 3.5 | 311 |
| Control | IPP | 50 | " | Polyamide | 43 | 3.5 | 15.7 |
| 7 | IPP | 50 | " | " | 43 | 3.5 | 98.6 |
| Control | IPP | 50 | " | VOAC:2EHA | 43 | 3.5 | 2.5 |
| 8 | IPP | 50 | Atactic polypropylene | VOAC:2EHA | 43 | 3.5 | 12.0 |
| Control | IPP | 50 | " | VA:EA:2EHA:AA | 43 | 3.5 | 4.4 |
| 9 | IPP | 50 | " | " | 43 | 3.5 | 15.3 |
| Control | ASA | 150 | Polyamide | PEPU | 43 | 2.8 | 76.5 |
| 10 | ASA | 150 | " | PEPU | 43 | 2.8 | 1,820 |

*Test ended after 10,000 minutes, whether or not failure had occurred.

Those skilled in the art will readily recognize that practice of the invention is susceptible of many variations without departure from the spirit of what has been disclosed. For example, the dimensions recited are not intended to be narrowly applied. It has been found, however, that it is preferable for the slope of the tapered area to be linear rather than either concave or convex. Both of the latter slopes are effective to a degree but tend to be more prone to failure of the seal because of peel forces. It has been found that the greater the angle of slope with respect to the flat portion of the lid, the greater the capacity of the closure to transmit pressure to the shear mode and hence resist failure by peeling. Slopes greater than 45° are hard to attain on conventional steel but can be achieved with other metals; such slopes, however, require an extremely compliant, albeit strong, sealing tab; thus, although a 90° slope is theoretically ideal, it is generally quite impractical to attain.

It is not feasible to provide an exhaustive list of the various components, which might be employed in practicing the invention. It has been demonstrated, however, that various polymeric films and laminates can be used as backings for the closures, and that any primer must take account of both the backing and the subsequently applied adhesive. Although normally tacky and pressure-sensitive adhesives possess many advantages, hot melt adhesives, especially those which become tacky when heated and remain tacky for some time thereafter, are also useful. Presumably highly elastic thermoset resins could also be employed.

It will likewise be appreciated that while the major utility of structures formed in accordance with the invention resides in the packaging of pressure-generating liquid, such structures also find application in the packaging of particulate or non-pressure generating liquid material, the slightly elevated area surrounding the pour hole facilitating removal of the contents in a simple and convenient manner.

What is claimed is as follows:

1. A method of making an end piece for use in fabricating a sealed pressurized container, comprising the steps of obtaining a pre-formed circular end piece of the type used in fabricating metal cans, said end piece having a depressed center portion with a pour hole therein and a circumferential lip for clamping over and sealing to one end of an annular can body, applying a strip of normally tacky and pressure-sensitive tape to the depressed center portion so as to overlie the pour hole and be sealed to the circumjacent surface, supporting the taped side of the end piece with a support means in an area adjacent to but spaced slightly radially outward from the pour hole, firmly gripping the end piece in said area, and providing a blunt punch with a tapered head which has a varying cross-sectional diameter in planes taken at right angles to its axis, the distal end of the punch head having a cross-sectional diameter smaller than the corresponding diameter of the pour hole and the main body of the punch head having a corresponding diameter larger than that of the pour hole, and forcing the punch head into the pour hole, thereby imparting an outwardly tapered configuration to the taped side of the end piece in the area circumjacent the pour hole, simultaneously stretching the tape and leaving it firmly adhered to the end piece.

2. The method of claim 1 wherein the pour hole is circular, the support means is a metal plate having a hole slightly larger than the pour hole and the punch head is a uniformly beveled cylinder.

3. The method of claim 1 wherein the support means is a yielding, resilient support.

* * * * *